US006546879B1

(12) United States Patent
Johnston

(10) Patent No.: US 6,546,879 B1
(45) Date of Patent: Apr. 15, 2003

(54) SHELF SYSTEM FOR A PATIO OR PORCH

(76) Inventor: Edward M. Johnston, 3257 East 46th Avenue, Vancouver, BC (CA), V5S 1B2

( * ) Notice: Subject to any disclaimer, the term of this patent is extended or adjusted under 35 U.S.C. 154(b) by 0 days.

(21) Appl. No.: 10/051,034

(22) Filed: Jan. 18, 2002

(51) Int. Cl.[7] ..... A47B 5/00
(52) U.S. Cl. ..... 108/47; 108/152
(58) Field of Search ..... 108/42, 48, 47, 108/92, 96, 94, 93, 152

(56) References Cited

U.S. PATENT DOCUMENTS

| | | | | |
|---|---|---|---|---|
| 3,136,520 | A | | 6/1964 | Reiss |
| 3,848,844 | A | | 11/1974 | Barrett |
| 4,270,463 | A | | 6/1981 | Korzon |
| 4,411,400 | A | * | 10/1983 | Everett |
| D288,900 | S | | 3/1987 | Gohrig |
| 4,901,965 | A | | 2/1990 | Bowman |
| 5,088,420 | A | * | 2/1992 | Russell |
| 5,364,052 | A | | 11/1994 | De Gruttis |
| 5,528,993 | A | * | 6/1996 | Vincelli |
| 5,598,662 | A | | 2/1997 | Droste |
| 5,653,178 | A | * | 8/1997 | Huczka |
| 5,722,329 | A | * | 3/1998 | Weng |
| 6,148,738 | A | * | 11/2000 | Richter |
| 6,158,360 | A | * | 12/2000 | Cheng |

* cited by examiner

*Primary Examiner*—Jose V. Chen

(57) ABSTRACT

A shelf system for a patio or porch for holding and elevating pots for increased ease of maintenance. The shelf system for a patio or porch includes a rail assembly having an upright rail; a plurality of shelf assemblies, each being coupled to the upright rail of the rail assembly; the plurality of shelf assemblies including a top rail shelf assembly having a top shelf collar coupled to the upright rail, a top shelf support bracket coupled to the top shelf collar, and a top shelf member coupled to the top shelf support bracket; and a lower shelf assembly having a lower shelf collar coupled to the upright rail, a lower shelf bracket coupled to the lower shelf collar, and a lower shelf member coupled to the lower shelf support bracket.

8 Claims, 4 Drawing Sheets

SHELF SYSTEM FOR A PATIO OR PORCH

BACKGROUND OF THE INVENTION

1. Field of the Invention

The present invention relates to shelving systems and more particularly pertains to a new shelf system for a patio or porch for holding and elevating pots for increased ease of maintenance.

2. Description of the Prior Art

The use of shelving systems is known in the prior art. More specifically, shelving systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,270,463; 5,364,052; 5,598,662; 3,136,520; 4,901,965; U.S. Pat. No. Des. 288,900; and U.S. Pat. No. 3,848,844.

While these devices fulfill their respective, particular objectives and requirements, the aforementioned patents do not disclose a new shelf system for a patio or porch. The inventive device includes a rail assembly having an upright rail; a plurality of shelf assemblies, each being coupled to the upright rail of the rail assembly; the plurality of shelf assemblies including a top rail shelf assembly having a top shelf collar coupled to the upright rail, a top shelf support bracket coupled to the top shelf collar, and a top shelf member coupled to the top shelf support bracket; and a lower shelf assembly having a lower shelf collar coupled to the upright rail, a lower shelf bracket coupled to the lower shelf collar, and a lower shelf member coupled to the lower shelf support bracket.

In these respects, the shelf system for a patio or porch according to the present invention substantially departs from the conventional concepts and designs of the prior art, and in so doing provides an apparatus primarily developed for the purpose of holding and elevating pots for increased ease of maintenance.

SUMMARY OF THE INVENTION

In view of the foregoing disadvantages inherent in the known types of shelving systems now present in the prior art, the present invention provides a new shelf system for a patio or porch construction wherein the same can be utilized for holding and elevating pots for increased ease of maintenance.

The general purpose of the present invention, which will be described subsequently in greater detail, is to provide a new shelf system for a patio or porch apparatus and method which has many of the advantages of the shelving systems mentioned heretofore and many novel features that result in a new shelf system for a patio or porch which is not anticipated, rendered obvious, suggested, or even implied by any of the prior art shelving systems, either alone or in any combination thereof.

To attain this, the present invention generally comprises a rail assembly having an upright rail; a plurality of shelf assemblies, each being coupled to the upright rail of the rail assembly; the plurality of shelf assemblies including a top rail shelf assembly having a top shelf collar coupled to the upright rail, a top shelf support bracket coupled to the top shelf collar, and a top shelf member coupled to the top shelf support bracket; and a lower shelf assembly having a lower shelf collar coupled to the upright rail, a lower shelf bracket coupled to the lower shelf collar, and a lower shelf member coupled to the lower shelf support bracket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shelf system for a patio or porch apparatus and method which has many of the advantages of the shelving systems mentioned heretofore and many novel features that result in a new shelf system for a patio or porch which is not anticipated, rendered obvious, suggested, or even implied by any of the prior art shelving systems, either alone or in any combination thereof.

It is another object of the present invention to provide a new shelf system for a patio or porch which may be easily and efficiently manufactured and marketed.

It is a further object of the present invention to provide a new shelf system for a patio or porch which is of a durable and reliable construction.

An even further object of the present invention is to provide a new shelf system for a patio or porch which is susceptible of a low cost of manufacture with regard to both materials and labor, and which accordingly is then susceptible of low prices of sale to the consuming public, thereby making such shelf system for a patio or porch economically available to the buying public.

Still yet another object of the present invention is to provide a new shelf system for a patio or porch which provides in the apparatuses and methods of the prior art some of the advantages thereof, while simultaneously overcoming some of the disadvantages normally associated therewith.

Still another object of the present invention is to provide a new shelf system for a patio or porch for holding and elevating pots for increased ease of maintenance.

Yet another object of the present invention is to provide a new shelf system for a patio or porch which includes a rail assembly having an upright rail; a plurality of shelf assemblies, each being coupled to the upright rail of the rail assembly; the plurality of shelf assemblies including a top rail shelf assembly having a top shelf collar coupled to the upright rail, a top shelf support bracket coupled to the top shelf collar, and a top shelf member coupled to the top shelf support bracket; and a lower shelf assembly having a lower shelf collar coupled to the upright rail, a lower shelf bracket coupled to the lower shelf collar, and a lower shelf member coupled to the lower shelf support bracket.

Still yet another object of the present invention is to provide a new shelf system for a patio or porch that helps keep decks, patios and porches clean and organized.

Even still another object of the present invention is to provide a new shelf system for a patio or porch that can be used in to support plant containers from fences.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
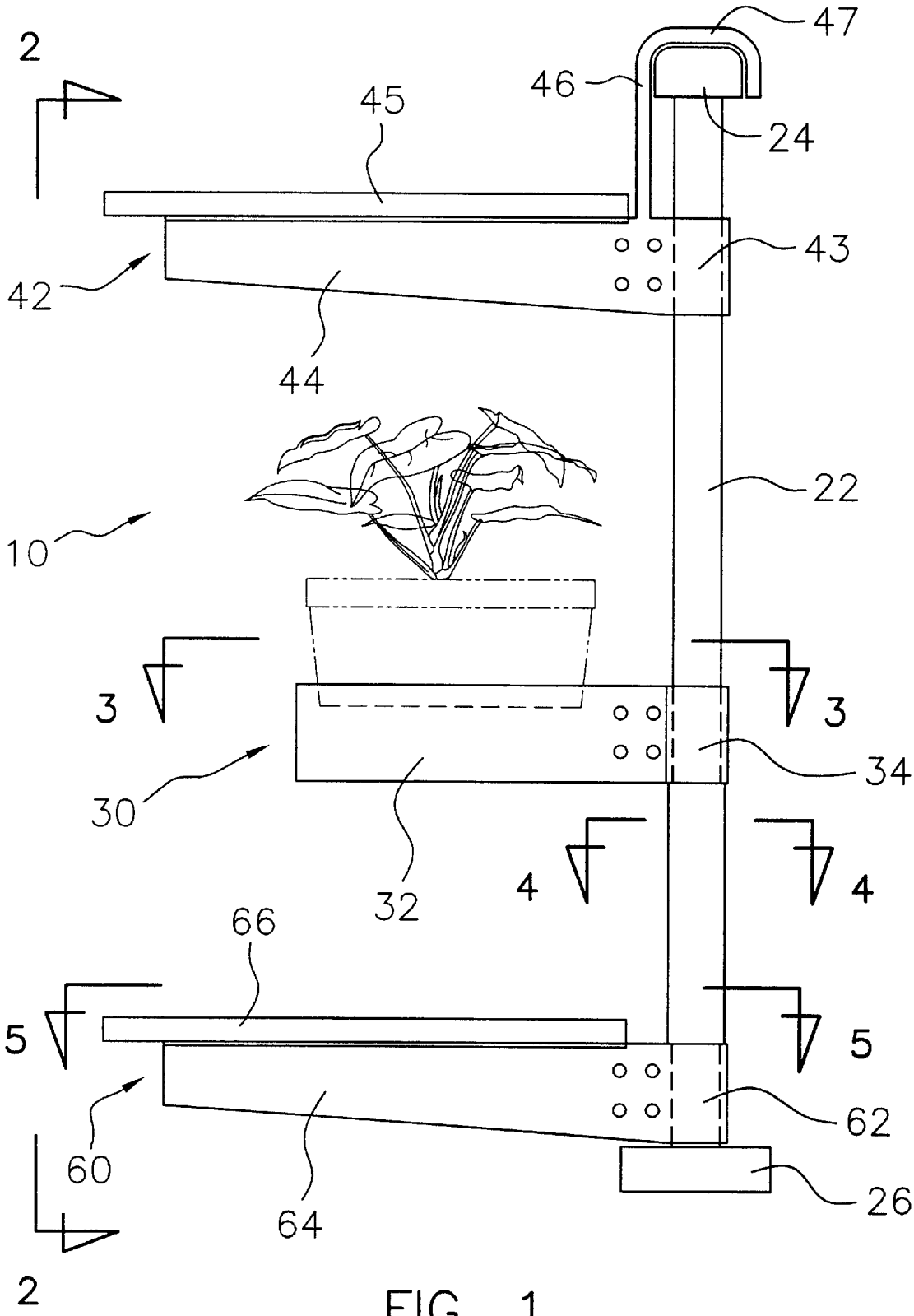
FIG. 1 is a schematic side view of a new shelf system for a patio or porch according to the present invention.
Figure 2:
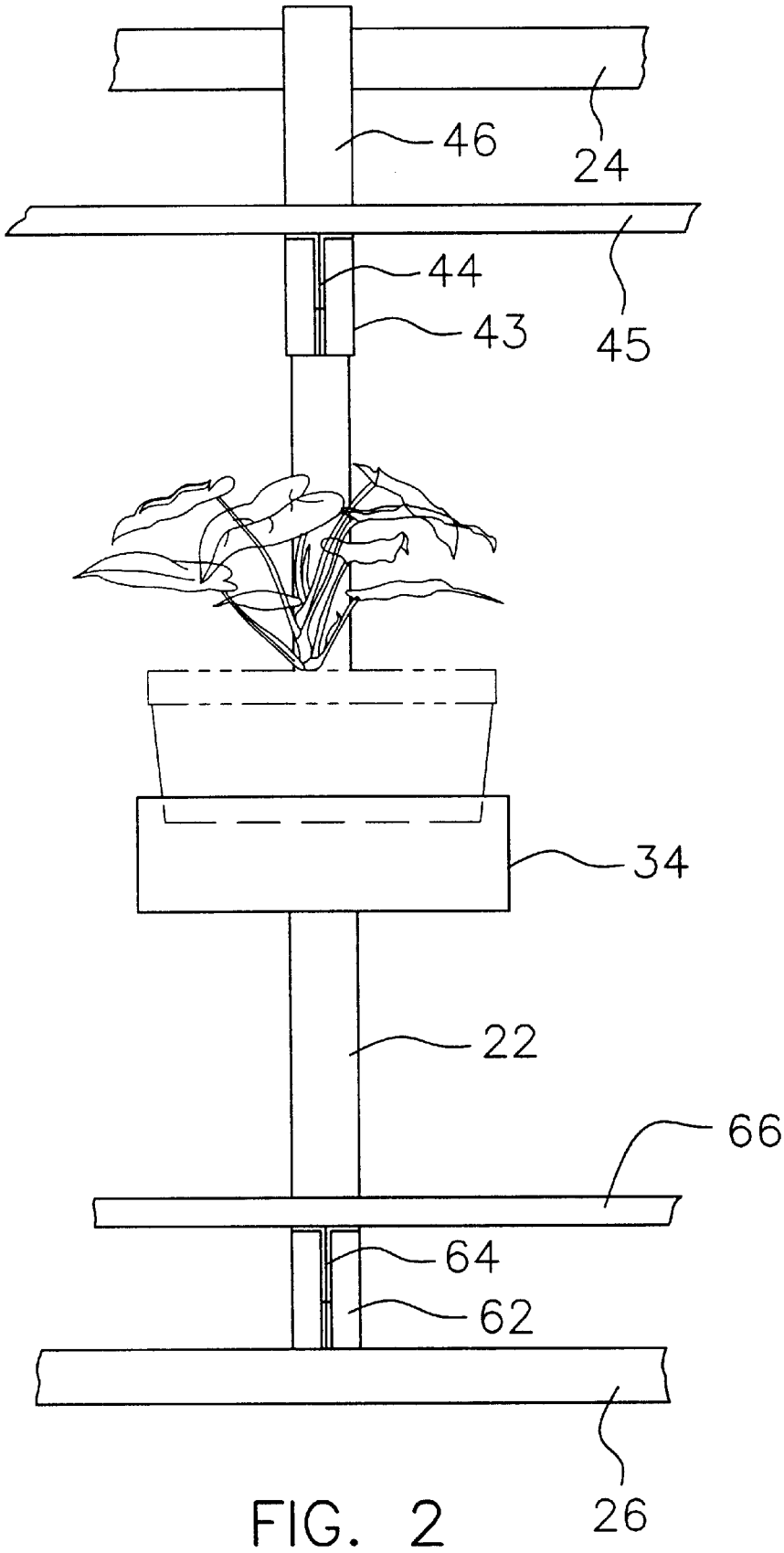
FIG. 2 is a schematic front view of the present invention.
Figure 3:
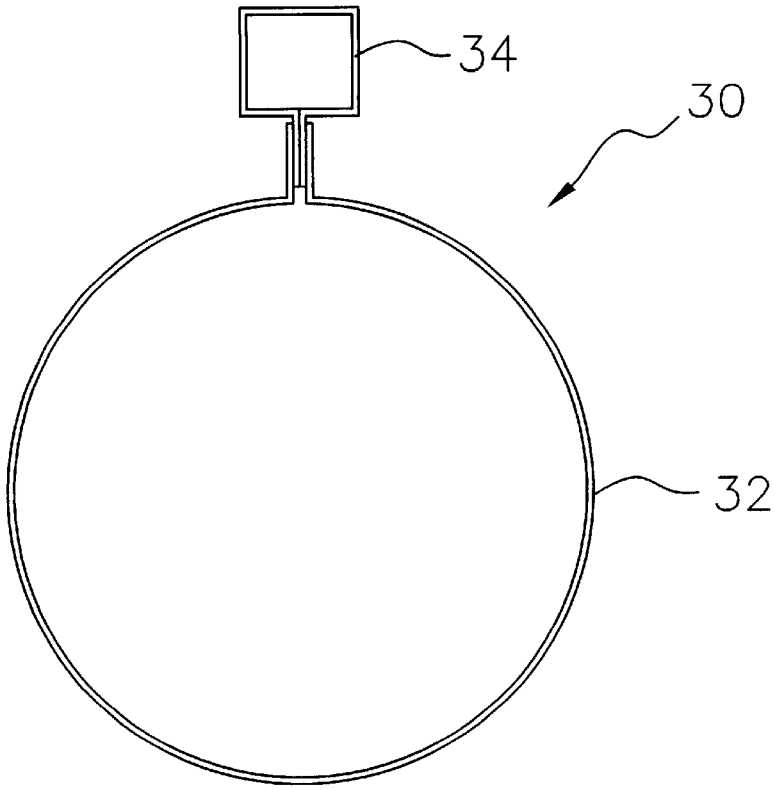
FIG. 3 is a schematic cross-sectional view of the present invention, taken along line 3—3 of FIG. 1.
Figure 4:
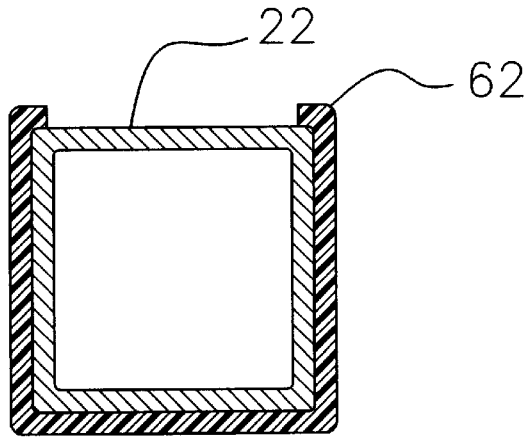
FIG. 4 is a schematic cross-sectional view of the present invention, taken along line 4—4 of FIG. 1.
Figure 5:
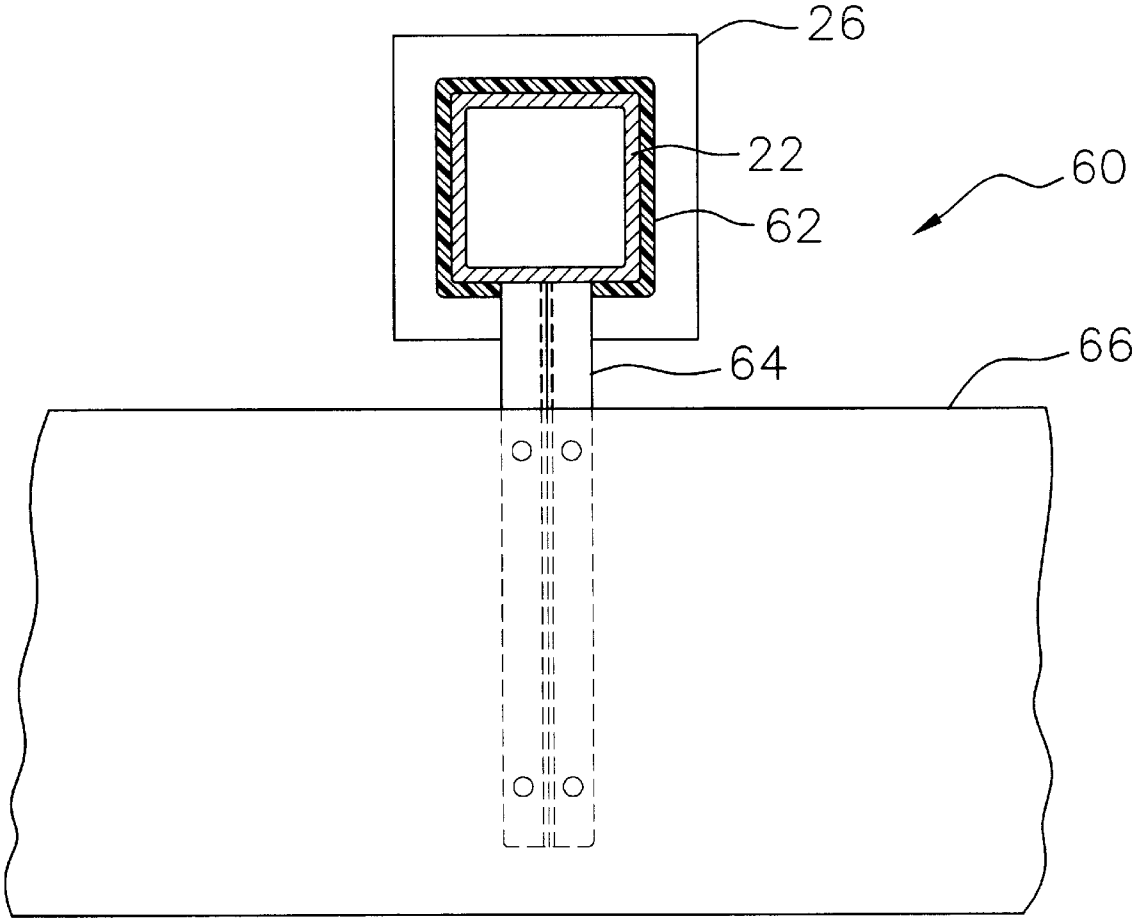
FIG. 5 is a schematic cross-sectional view of the present invention, taken along line 5—5 of FIG. 1.

With reference now to the drawings, and in particular to FIGS. 1 through 5 thereof, a new shelf system for a patio or porch embodying the principles and concepts of the present invention and generally designated by the reference numeral 10 will be described.

As best illustrated in FIGS. 1 through 5, the shelf system for a patio or porch 10 generally comprises a rail assembly 20, a plurality of shelf assemblies 40, and a lower shelf assembly 60.

The rail assembly 20 includes an upright rail 22. Each of the plurality of shelf assemblies 40 is coupled to the upright rail 22 of the rail assembly 20. The plurality of shelf assemblies 40 includes a top rail shelf assembly 42, which further includes a top shelf collar 43 coupled to the upright rail 22, a top shelf support bracket 44 coupled to the top shelf collar 43, and a top shelf member 45 coupled to the top shelf support bracket 44.

The lower shelf assembly 60 includes a lower shelf collar 62 coupled to the upright rail 22, a lower shelf bracket 64 coupled to the lower shelf collar 62, and a lower shelf member 66 coupled to the lower shelf support bracket 64.

The top rail shelf assembly 42 includes an attachment portion 46, which extends upwardly above the top shelf member 45. The attachment portion 46 includes a curved distal end 47 extending over a generally horizontal top rail 24 of the rail assembly 20. Thus, the attachment portion 46 prevents the top rail shelf assembly 42 from sliding down the upright rail 22.

The lower shelf collar 62 receives the upright rail 22 such that the lower shelf collar 62 is slidable on the upright rail 22.

The rail assembly 20 includes a cross rail 26 positioned below the lower shelf collar 62. Thus, the lower shelf collar 62 is supported by the cross rail 26.

The top shelf member 45 is rectangular, square, round, triangular or oval. Similarly, the lower shelf member 45 is also rectangular, square, round, triangular or oval.

A pot supporting assembly 30 includes a pot support collar 34 coupled to the upright rail 22 and a main support member 32 coupled to the pot support collar 34. The main support member 32 includes a perimeter designed for receiving and supporting a pot.

The pot support collar 34 receives the upright rail 22 such that the pot support collar 34 is slidable on the upright rail 22. The upright rail 22 includes an abutment surface, which extends transversely from an exterior surface of the upright rail 22. Thus, the pot support collar 34 is supported by the abutment surface.

A top rail protective member may be positionable between the top rail 24 and the attachment portion for preventing direct contact between the top rail 24 and the attachment portion 46 to prevent damage to the top rail 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shelf system for a patio or porch, said shelf system comprising:

a rail assembly having an upright rail a plurality of shelf assemblies, each said shelf assemblies being coupled to said upright rail of said rail assembly;

said plurality of shelf assemblies including a top rail shelf assembly, said top rail shelf assembly having a top shelf collar coupled to said upright rail, a top shelf support bracket coupled to said top shelf collar, and a top shelf member coupled to said top shelf support bracket;

a lower shelf assembly having a lower shelf collar coupled to said upright rail, a lower shelf bracket coupled to said lower shelf collar, and a lower shelf member coupled to said lower shelf support bracket;

said lower shelf collar receiving said upright rail such that said lower shelf collar is slidable on said upright rail; and said rail assembly including a cross rail positioned below said lower shelf collar whereby said lower shelf collar is supported by said cross rail.

2. The shelf system of claim 1, further comprising:

said top rail shelf assembly including an attachment portion extending upwardly above said top shelf member, said attachment portion having a curved distal end extending over a generally horizontal top rail of the rail assembly whereby said attachment portion prevents said top rail shelf assembly from sliding down said upright rail.

3. The shelf system of claim 2, further comprising:

a top rail protective member positionable between said top rail and said attachment portion for preventing direct contact between said top rail and said attachment portion to prevent damage to said top rail.

4. The shelf system of claim 1, further comprising:

said lower shelf collar receiving said upright rail such that said lower shelf collar is slidable on said upright rail; and said upright rail having an abutment surface extending transversely from an exterior surface of said upright rail whereby said lower shelf collar is supported by said abutment surface.

5. The shelf system of claim 1, further comprising:

said top shelf member having a shape selected from the group of shapes consisting of rectangular, square, round, triangular and oval.

6. The shelf system of claim 1, further comprising:

a pot supporting assembly having a pot support collar coupled to said upright rail and a main support member coupled to said pot support collar, said main support member having a perimeter adapted for receiving and supporting a pot.

7. The shelf system of claim 6, further comprising:

said pot support collar receiving said upright rail such that said pot support collar is slidable on said upright rail; and said upright rail having an abutment surface extending transversely from an exterior surface of said upright rail whereby said pot support collar is supported by said abutment surface.

8. A shelf system for a patio or porch, said shelf system comprising:

a rail assembly having an upright rail;

a plurality of shelf assemblies, each of said shelf assemblies being coupled to said upright rail of said rail assembly;

said plurality of shelf assemblies including a top rail shelf assembly, said top rail shelf assembly having a top shelf collar coupled to said upright rail, a top shelf support bracket coupled to said top shelf collar, and a top shelf member coupled to said top shelf support bracket;

a lower shelf assembly having a lower shelf collar coupled to said upright rail, a lower shelf bracket coupled to said lower shelf collar, and a lower shelf member coupled to said lower shelf support bracket;

said top rail shelf assembly including an attachment portion extending upwardly above said top shelf member, said attachment portion having a curved distal end extending over a generally horizontal top rail of the rail assembly whereby said attachment portion prevents said top rail shelf assembly from sliding down said upright rail;

said lower shelf collar receiving said upright rail such that said lower shelf collar is slidable on said upright rail;

said rail assembly including a cross rail positioned below said lower shelf collar whereby said lower shelf collar is supported by said cross rail;

said top shelf member having a shape selected from the group of shapes consisting of rectangular, square, round, triangular and oval;

said lower shelf member having a shape selected from the group of shapes consisting of rectangular, square, round, triangular and oval;

a pot supporting assembly having a pot support collar coupled to said upright rail and a main support member coupled to said pot support collar, said main support member having a perimeter adapted for receiving and supporting a pot;

said pot support collar receiving said upright rail such that said pot support collar is slidable on said upright rail;

said upright rail having an abutment surface extending transversely from an exterior surface of said upright rail whereby said pot support collar is supported by said abutment surface;

a top rail protective member positionable between said top rail and said attachment portion for preventing direct contact between said top rail and said attachment portion to prevent damage to said top rail.

* * * * *